United States Patent [19]

Suzuki

[11] Patent Number: 5,014,825

[45] Date of Patent: May 14, 1991

[54] RESCUE OPERATING APPARATUS FOR ELEVATOR

[75] Inventor: Shigehiko Suzuki, Inazawa, Japan

[73] Assignee: Mitsubishi Denki Kabushiki Kaisha, Japan

[21] Appl. No.: 391,033

[22] Filed: Aug. 9, 1989

[30] Foreign Application Priority Data

Aug. 11, 1988 [JP] Japan ..... 63-200710

[51] Int. Cl.[5] ..... B66B 13/24

[52] U.S. Cl. ..... 187/104

[58] Field of Search ..... 187/104, 105

[56] References Cited

U.S. PATENT DOCUMENTS

| | | | |
|---|---|---|---|
| 1,870,772 | 8/1932 | Eames | 187/104 |
| 4,308,936 | 1/1982 | Caputo et al. | 187/104 |
| 4,367,810 | 1/1983 | Doane et al. | 187/105 X |
| 4,505,360 | 3/1985 | Tsuji | 187/104 |
| 4,662,478 | 5/1987 | Uchino | 187/114 |

FOREIGN PATENT DOCUMENTS 57-13073 1/1982 Japan .

*Primary Examiner*—A. D. Pellinen
*Assistant Examiner*—W. E. Duncanson, Jr.
*Attorney, Agent, or Firm*—Leydig, Voit & Mayer

[57] ABSTRACT

A rescue operating apparatus for an elevator has a device for transmitting a cage door open/close command from an elevator supervising section which receives notice regarding the trouble of the elevator and the stopping of the cage between floors, and an operation control device for controlling a door driver on the basis of a door open/close command from the command transmitting means to open/close the cage door thereby to confirm the full closure of the door and then control the elevator driver, thereby performing the rescue operation of the cage.

2 Claims, 2 Drawing Sheets

RESCUE OPERATING APPARATUS FOR ELEVATOR

BACKGROUND OF THE INVENTION

The present invention relates to a rescue operating apparatus for an elevator adapted to rescue a passenger enclosed in a cage.

When a cage is stopped in emergency out of a door zone due to a trouble of an elevator controller, a passenger is enclosed in the cage since the elevator door is not opened. In such a case, it is necessary to rescue the passenger as early as possible.

Heretofore, such a prior-art rescue operating apparatus for an elevator is disclosed, for example in Japanese laid-open patent application No. 13073/1982.

FIG. 2 is a view of an arrangement showing a prior-art rescue operating apparatus for an elevator.

In the drawing, a cage 1 and a counterweight 2 are respectively suspended from one end and the other end of a rope 4 wound around a sheave 3. Numeral 5 denotes an electric motor for driving the sheave 3. The electric motor 5 is controlled by a speed controller 6. The speed controller 6 receives a signal from a relay circuit 7. Numeral 8 denotes a trouble detector composed of a microcomputer for generating a command to a telephone automatic notifying device 9 when it detects the trouble of the elevator to automatically dial to the telephone set 11 of an elevator supervising section 10, thereby notifying the trouble through a telephone channel 12. A signal transmitted from the trouble detector 8 through the telephone channel 12 is received by a host computer 13 in the elevator supervising section 10, and displayed on a CRT display (not shown) so that the content of the trouble can be understood by a supervisor.

The automatic telephone notifying device 9 is connected through a telephone cable 15 to the telephone set 14 in the cage 1, and can talk with the telephone set 11 in the elevator supervising section 10.

If a safety device is operated during the elevation of the cage in the rescue operating apparatus for a prior-art elevator, the cage is stopped between the floors as described above. Then, the trouble detector 8 which detects this fact notifies the trouble through the automatic telephone notifying device 9 to the elevator supervising section 10. An operator in the supervising section 10 who receives this observes the content of the trouble on the display of the host computer 13 to confirm that the cage is stopped between the floors, and further confirms that there is a passenger in the cage through the telephone sets 11 and 14.

If the enclosed state of the passenger is confirmed and it is also confirmed that a rescue operation can be performed from the displayed content on the display, a command regarding the rescue operation of the cage is transmitted from the elevator supervising section 10 through the telephone channel 12 to the relay circuit 7 to operate the relay circuit 7 thereby to release the brake and to operate a rescue operating circuit, thereby operating to rescue the cage to the nearest floor.

However, there is a problem in the prior-art system that, if foreign matter is engaged at the cage door as a cause that the passenger is enclosed in the cage, the contact of the safety device for confirming that the door is completely closed is opened during elevating, and the cage is stopped in emergency.

In such a case, in the prior-art system, the open state of the contact of the door safety device can be confirmed on the display of the host computer, but the open state of the contact for confirming the full closure of the door due to the foreign matter engaged at the door cannot be returned to the full closure state by a command from the elevator supervising section. Thus, the rescue operation of the cage by the command from the supervising section is impossible, and the passenger remains enclosed in the cage for a long period of time until the operator arrives at the site and the contact for confirming the full closure of the door due to the foreign matter is returned to its normal state.

SUMMARY OF THE INVENTION

The present invention has been made to eliminate the above-described problems and has for its object the provision of a rescue operating apparatus for an elevator which can operate a rescue by a command from an elevator supervising section even if a contact for confirming the full closure of a cage door is opened due to foreign matter engaged at the door during elevating of the cage whereby the cage is stopped in emergency between floors so that a passenger is enclosed in the cage.

A rescue operating apparatus for an elevator according to the present invention comprises means for transmitting an open/close command of a cage door from an elevator supervising section receiving notice regarding the trouble of a cage and the state of stopping of the cage between floors due to the trouble. An operation control means for controls a door driver in accordance with a door open/close command from the command transmitting means to open/close the cage door, confirming the full closure of the elevator door and controlling an elevator driver to perform this rescue operation of the cage.

In the present invention, when the cage is stopped between floors and the passenger is enclosed in the cage, a door open/close command is applied from the command transmitting means to the operation control means temporarily opening the cage door, thereby removing the open state of the door full closure confirming means due to foreign matter or the like, then closing the cage door. Thus, the full closure of the door is confirmed, and the elevator is operated to be rescued.

Therefore, in the present invention, even if foreign matter is engaged at the cage door and the elevator is stopped in emergency, the cause of the open door can be removed by a command from the elevator supervising section without bringing an operator to the site of the troubled elevator and the elevator can be operated to be rescued.

BRIEF DESCRIPTION OF THE DRAWINGS

In the drawings, the same symbols indicate identical or corresponding portions.

DESCRIPTION OF THE PREFERRED EMBODIMENTS

An embodiment of the present invention will be described in detail with reference to FIG. 1.

Figure 1:
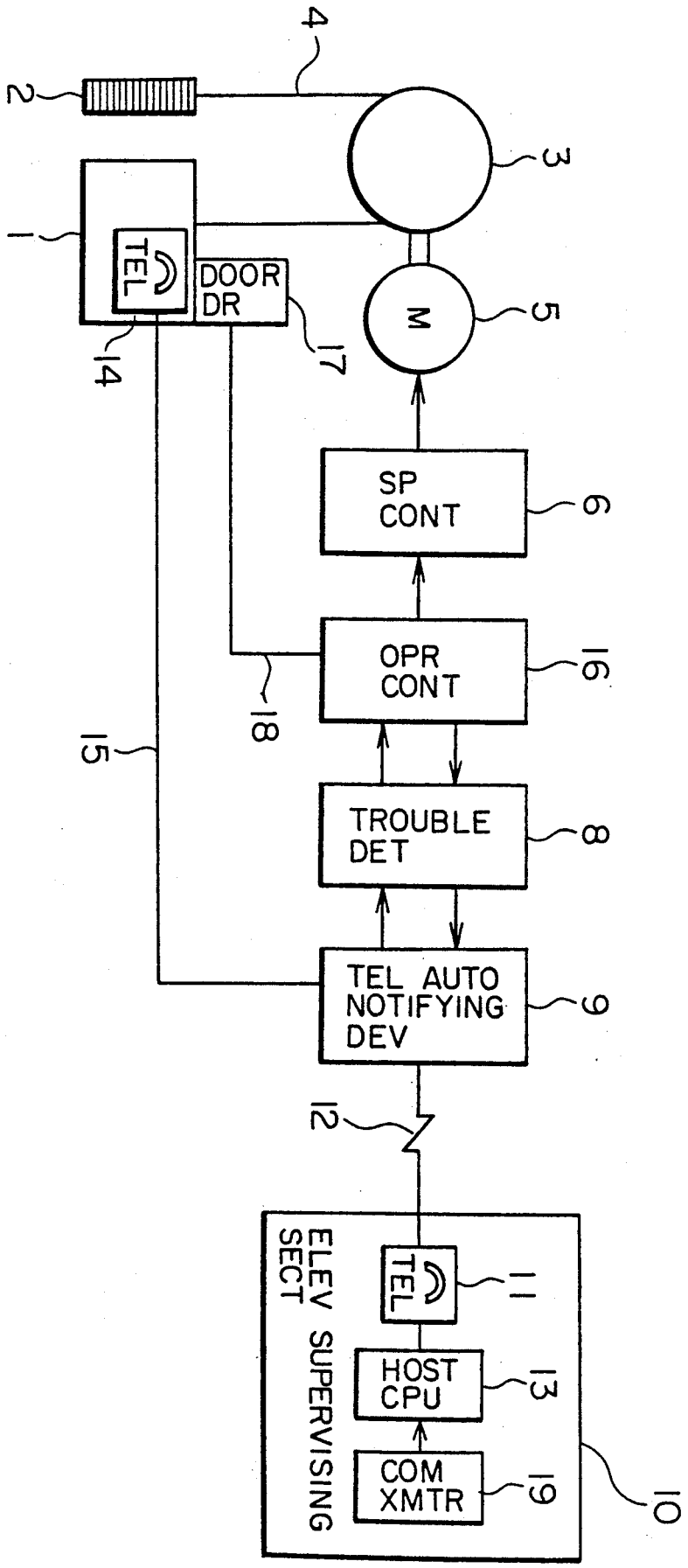
FIG. 1 is a view of an overall arrangement of an embodiment of a rescue operating apparatus for an elevator according to the present invention.
Figure 2:
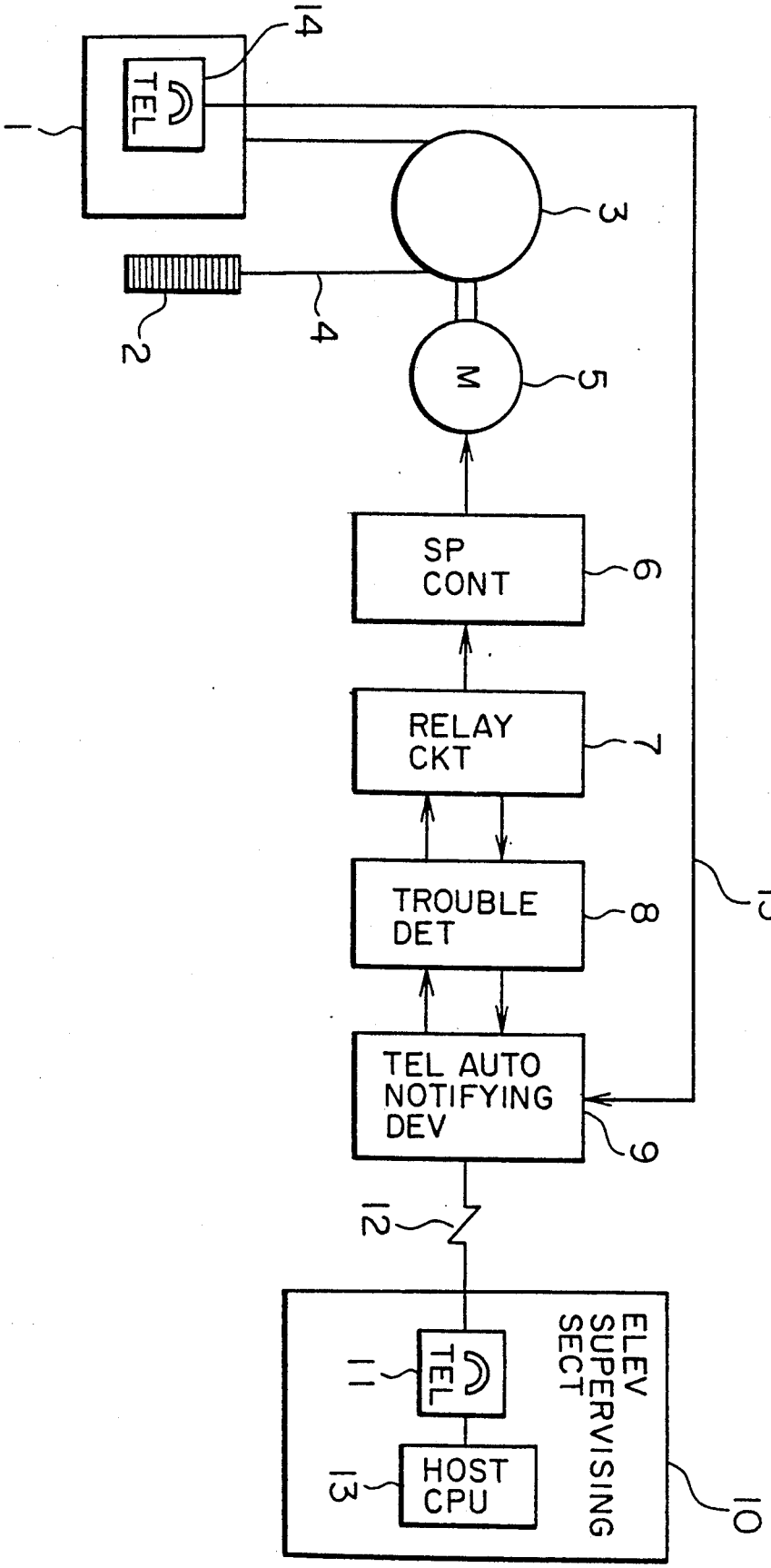
FIG. 2 PRIOR ART
FIG. 2 is a view of an overall arrangement of a prior-art rescue operating apparatus for an elevator.

In FIG. 1, reference numeral 1 denotes a cage and numeral 2 denotes a counterweight, the cage 1 and the counterweight 2 respectively suspended from one end and the other end of a rope 4 wound around a sheave 3. Numeral 5 denotes an electric motor for driving the sheave 3. The electric motor 5 is controlled by a speed controller 6. The speed controller 6 receives a speed signal from an operation controller 16. Numeral 17 denotes a door driver installed in the cage 1. A door control command is supplied from the operation controller 16 through a control cable 18 to the door driver 17.

Numeral 8 denotes a trouble detector for an elevator, connected to the operation controller 16 to generate a command signal to a telephone automatic notifying device 9 when it detects the trouble of the elevator to automatically dial to the telephone set 11 of the elevator supervising section 10, thereby notifying the trouble through a telephone channel 12.

A transmission signal from the trouble detector 8 is also supplied to a monitoring host computer 13 installed in the elevator supervising section 10. The host computer 13 receives a signal from the trouble detector 8, and displays the content of the trouble on a CRT display (not shown) for a monitoring operator to discriminate it.

A command transmitter 19 for transmitting cage door open/close command is connected to the host computer 13 of the elevator supervising section 10.

A telephone set 14 provided in the cage 1 is connected through a telephone cable 15 to the telephone automatic notifying device 9 so that a passenger in the cage can talk through the telephone set 11 of the elevator supervising section 10 with the monitoring operator in the elevator supervising section 10.

Next, the operation of this embodiment constructed as described above, at the time of trouble will be described.

Assume that, when the contact of a safety device is operated during elevating of the cage, the trouble detector 8 detects the trouble and applies an emergency stop command to the operation controller 16 so that the cage is stopped in emergency. In this case, if the stopping position of the cage is out of its door zone, the door cannot be opened. Accordingly, if there is a passenger in the cage 1, a trouble of enclosing the passenger in the cage occurs.

On the other hand, the trouble detector 8 detects that the cage is stopped out of its door zone to judge it as a trouble, thereby automatically transmitting a signal to the automatic notifying device 9. Thus, the automatic notifying device 9 automatically dials to the telephone set 11 of the elevator supervising section 10 to notify the trouble. A monitoring operator observes the content displayed on the display of the host computer 13 in the elevator supervising section 10 receiving the notice of the trouble, thereby notifying the stop of the cage out of its door zone. In this case, the operator intends to talk with the passenger through the telephone set 11, and if he can receive a passenger's response, the fact that the passenger is enclosed in the cage can be confirmed.

Since the operator can notify which safety device is operated on the CRT display, the operator gives an instruction saying "since the door will be once opened, please move to the opposite side of the door in the cage." to the passenger through the telephone set 11 if the contact for confirming the full closure of the door is opened at that time. After the movement of the passenger is confirmed, door open/close command is transmitted from a command transmitter 19 through the host computer 13 and the telephone channel 12 to the operation controller 16 thereby to operate the door driver 17, thereby opening temporarily the door and then again closing it.

The opening distance of the door in this case is limited to a range that a person cannot pass through so as to prevent the passenger from erroneously falling down into an elevator shaft.

Generally, the foreign matter is removed by once opening the elevator door, but if the foreign matter cannot be removed by mere opening and closing operations of the door, the foreign matter may be removed by requesting the passenger through the telephone sets 11 and 14.

When the operator confirms that the foreign matter is removed and the contact for confirming the full closure of the door is closed on the CRT display of the host computer 13, a rescue operation signal is fed from the input unit (not shown) of the host computer 13 to the operation controller 16 to operate the speed controller 6, thereby elevating the cage to the door opening/closing zone. Thus, the door is fully opened, and the passenger enclosed in the cage is rescued.

In the embodiment described above, the case, after the contact for confirming the full closure of the door is closed, of the elevator being operated for its rescue by the command of the operator from the elevator supervising section 10, has been described. However, the present invention is not limited to this particular embodiment. For example, after the trouble detector 8 confirms the closure of the contact for confirming the full closure of the door, a rescue operation signal may be fed to the operation controller 16, thereby automatically performing a rescue operation. Further, in the embodiment described above, the case that the foreign matter is engaged at the door, has been described. However, the present invention is not limited to that particular embodiment. For example, even when the contact for confirming the full closure of the door is opened due to other causes (e.g., the improper contact of the contact itself for confirming the full closure of the door), the cage is stopped between floors and the passenger is enclosed in the cage. A door open/close command is transmitted similarly from the supervising section 10 to open or close the door, thereby resetting the contact for confirming the full closure of the door to its closed state. Thus, the cage may be rescued to the nearest floor of the cage disposed at present, and the passenger enclosed in the cage may be rapidly rescued from the enclosed state.

According to the present invention as described above, when the foreign matter is engaged at door so that the contact for confirming the full closure of the door is opened during elevating of the cage and the cage is thus stopped in emergency between the floors so that the passenger is enclosed in the cage, the door open/close command is applied from the elevator supervising section to the elevator operation controller, the door is temporarily opened, the cause of opening the contact for confirming the full closure of the cage due to foreign matter is removed, and the door is then closed thereby to confirm the closed state of the contact for confirming the full closure of the door and then to conduct the rescue operation of the elevator. Therefore, even if foreign matter is engaged at the door and the cage is stopped in emergency between the floors, the cause of opening the contact for confirming the full closure of the door can be removed merely by the door open/close command from the elevator supervising section without bringing the monitoring operator to the site, and the elevator is operated for its rescue, thereby rescuing the passenger enclosed in the cage.

What is claimed is:

1. A rescue apparatus for an elevator including a cage operating between floors and having a door which normally can be opened only in a door zone defined relative to a floor, the rescue apparatus comprising:

a cage driver connected to the cage to move the cage up or down;

a door driver connected to the cage door to open or close the door;

an elevator supervising section which generates and transmits a cage door open/close command;

detecting means for detecting trouble regarding the operation of the cage when the cage position is out of the door zone;

notifying means connected between the detecting means and said elevator supervising section for notifying said elevator supervising section of the trouble and the door zone status of the cage; and operation control means operable responsive to the door open/close command for controlling said door driver to open the door temporarily and then close the door when the cage position is out of the door zone and for then controlling said cage driver to move the cage up or down to a position in the door zone when said detecting means detects the trouble is cleared.

2. A rescue apparatus according to claim 1 wherein the opening distance of the door when opened temporarily is limited so that a person cannot pass through the opening.

* * * * *